US012618203B2

(12) United States Patent
Zhai et al.

(10) Patent No.: US 12,618,203 B2
(45) Date of Patent: May 5, 2026

(54) MACHINE, SYSTEM AND METHOD FOR ROAD CONSTRUCTION

(71) Applicant: IDAHO ASPHALT SUPPLY, INC., Idaho Falls, ID (US)

(72) Inventors: Huachun Zhai, Boise, ID (US); Scott McGowan, Coeur d'Alene, ID (US); Alejandro Rosales, Nampa, ID (US); Douglas R. Olsen, Reno, NV (US)

(73) Assignee: IDAHO ASPHALT SUPPLY, INC., Idaho Falls, ID (US)

( * ) Notice: Subject to any disclaimer, the term of this patent is extended or adjusted under 35 U.S.C. 154(b) by 608 days.

(21) Appl. No.: 18/182,292

(22) Filed: Mar. 10, 2023

(65) Prior Publication Data

US 2023/0304233 A1 Sep. 28, 2023

Related U.S. Application Data

(60) Provisional application No. 63/323,803, filed on Mar. 25, 2022.

(51) Int. Cl.

| | |
|---|---|
| ***E01C 23/01*** | (2006.01) |
| ***E01C 19/00*** | (2006.01) |
| ***E01C 19/17*** | (2006.01) |

(52) U.S. Cl.

CPC ..... *E01C 23/01* (2013.01); *E01C 19/004* (2013.01); *E01C 19/17* (2013.01); *E01C 19/174* (2013.01); *E01C 19/176* (2013.01)

(58) Field of Classification Search

CPC ..... E01C 19/004; E01C 19/17; E01C 19/174; E01C 19/176; E01C 23/01

(Continued)

(56) References Cited

U.S. PATENT DOCUMENTS

| | | | |
|---|---|---|---|
| 3,904,293 | A | 9/1975 | Gee |
| 6,615,648 | B1 | 9/2003 | Ferguson et al. |

(Continued)

FOREIGN PATENT DOCUMENTS

| | | |
|---|---|---|
| EP | 0404623 A1 | 12/1990 |
| FR | 3098528 A1 | 1/2021 |

OTHER PUBLICATIONS

International Search Report mailed Jun. 23, 2023 for PCT/US2023/064205 to Idaho Asphalt Supply, Inc. filed on Mar. 12, 2023.

Christina Plati, Maria Pomoni and Tasos Stergiou, Development of a Mean Profile Depth to Mean Texture Depth Shift Factor for Asphalt Pavements, Transportation Research Record, 2641(1), 156-163, Downloaded on Feb. 28, 2023.

E.D. Etnyre & Co., Black-Topper Booklet, https://etnyre.com/wp-content/uploads/2021/09/A-142-19.pdf, Downloaded on Feb. 28, 2023.

(Continued)

*Primary Examiner* — William V Gilbert
(74) *Attorney, Agent, or Firm* — Ryan Stockett

(57) ABSTRACT

A machine is disclosed for use building a road. The machine may include a vehicle, and a distribution arrangement mounted to the vehicle and configured to distribute a material on to a surface as the vehicle moves over the surface. The machine may also include at least one sensor mounted to the vehicle and configured to generate a signal indicative of a texture of the surface during movement of the vehicle over the surface, a locating device configured to detect a location of the texture, and a controller. The controller may be specially programmed to determine an amount of the material to be applied to the location of the texture based on the signal, and to automatically cause the distribution arrangement to distribute the amount of the material on to the surface at the location of the texture as the vehicle moves over the surface.

25 Claims, 3 Drawing Sheets

(58) Field of Classification Search
USPC ..... 404/75
See application file for complete search history.

(56) References Cited

U.S. PATENT DOCUMENTS

| | | | | |
|---|---|---|---|---|
| 7,197,425 | B2 | 3/2007 | Masuyama et al. | |
| 8,941,739 | B2 | 1/2015 | Yoo | |
| 9,255,364 | B2 | 2/2016 | Ichikawa | |
| 9,366,529 | B2 | 6/2016 | Nakamura et al. | |
| 9,873,990 | B2 | 1/2018 | Frelich et al. | |
| 10,653,128 | B2 | 5/2020 | Brooks et al. | |
| 10,859,386 | B2 | 12/2020 | Rodoni | |
| 2006/0045620 | A1* | 3/2006 | Olson | E01C 19/48 404/101 |
| 2009/0142133 | A1 | 6/2009 | Glee et al. | |
| 2012/0205459 | A1 | 8/2012 | Bebb et al. | |
| 2016/0231752 | A1* | 8/2016 | Payne | E01C 23/08 |
| 2018/0155880 | A1* | 6/2018 | Cawthern | E01C 19/176 |
| 2019/0106846 | A1 | 4/2019 | Marsolek et al. | |
| 2019/0136467 | A1* | 5/2019 | Laugwitz | E01C 23/01 |
| 2019/0345677 | A1 | 11/2019 | Boston et al. | |
| 2020/0201307 | A1 | 6/2020 | Marsolek | |
| 2020/0292348 | A1 | 9/2020 | Chambers et al. | |
| 2021/0148063 | A1 | 5/2021 | Repiscak et al. | |
| 2022/0056649 | A1 | 2/2022 | Olsen et al. | |
| 2022/0251787 | A1 | 8/2022 | Buschmann | |

OTHER PUBLICATIONS

E.D. Etnyre & Co., It's the Truck Thing, https://etnyre.com/wp-content/uploads/2021/09/A-136-Truck-Thing.pdf, Downloaded on Feb. 27, 2023.

Robert Grisso, Mark Alley, Wade Thomason, David Holshouser, Gary T. Roberson, Precision Farming Tools: Variable-Rate Application, www.ext.vt.edu, 2011, VT/0711?web/442505, VirginiaTech, Downloaded on Feb. 28, 2023.

Dariene Goehl, Charles Gurganus, Kai-Wei Liu and Jia-Lin Hsu, Seal Coat Binder Rate Adjustments Using LIDAR Data, Texas Department of Transportation Research and Technology Implementation Office, Jun. 2021, Report 5-6963-01-R1, Texas A&M Transportation Institute The Texas A&M University System, Austin, TX, downloaded on Mar. 12, 2023.

Linda M. Pierce, Nathan Kebede, Chip Seal Performance Measures-Best Practices, Applied Pavement Technology, Mar. 2015, pp. 1-82, WA-RD 841.1, Urbana, IL, downloaded on Mar. 12, 2023.

M. Emin Kutay, Uguracan Ozdemir, An Acceptance Test for Chip Seal Projects Based on Image Analysis, Center for Highway Pavement Preservation, Michigan Department of Transportation, May 2016, Okemos, MI, downloaded on Mar. 12, 2023.

* cited by examiner

MACHINE, SYSTEM AND METHOD FOR ROAD CONSTRUCTION

RELATED APPLICATIONS

This application is based on and claims the benefit of priority from U.S. Provisional Application No. 63/323,803 that was filed on Mar. 25, 2022, the contents of which are expressly incorporated herein by reference.

TECHNICAL FIELD

The present disclosure relates generally to road construction and, more particularly, to a machine, system and method for constructing a road.

BACKGROUND

For the purposes of this disclosure, a road can be considered a durable surface (e.g., a route, way, path, drive, street, lane, lot, or similar thoroughfare or park) that has been prepared on land or over water to support any one or more of various types of traffic (e.g., vehicular traffic, pedestrian traffic, railway traffic, aircraft ground traffic, bicycle traffic, etc.). While roads can be constructed in a variety of different ways, most of these ways involve the application of a specialized material to an existing or newly prepared surface.

Asphalt is one example of a material specially prepared for use in building roads. Asphalt, also known as bitumen, is a binder used to adhere filler or reinforcement (e.g., sand, aggregate, etc.) together and to the underlying surface. An asphalt road is durable and flexible, allowing expansion and contraction without damage. The asphalt can be asphalt cement (AC), polymer modified asphalt (PMA), cutback, and emulsions. Other materials (e.g., primers, hardeners, additives, etc.) may be used together with asphalt when building roads.

Many different methods exist for applying asphalt (and/or other building materials) to an underlying surface during the making of a road. One method is known as Chip Sealing. During the Chip Sealing process, an asphalt mixture is prepared and loaded into a spray truck (e.g., the Blacktopper Centennial Distributor by E. D. Etnyre & Co. or the Asphalt Distributor BC-502 by Bearcat Manufacturing). The spray truck is equipped with a vessel that holds the emulsion, and a spray bar at a trailing end of the vessel that extends transversely across a width of the road. Any number of nozzles are mounted to the spray bar. An engine-driven pump presses the asphalt mixture from the vessel through the spray bar and nozzles and onto the underlying surface behind the spray truck, while the spray truck travels along a length of the surface. In some applications, another machine follows behind the spray truck and applies aggregate over the layer of asphalt, while yet another machine compacts the aggregate into the asphalt.

During the building of a road, it is possible to apply an incorrect amount of asphalt. When too much asphalt is applied, the asphalt can flush up through the aggregate and form a smooth upper surface that is slippery. An excessive amount of asphalt is also wasteful and expensive. When too little asphalt is applied, the aggregate may not stick to the road and can cause damage to vehicles traveling the road as the aggregate unravels from the underlying surface.

Typically, the asphalt is applied by the nozzles of the spray truck at a predetermined rate (e.g., a set volumetric amount per area of roadway) based on a plan generated in advance for a particular road. The road plan is manually prepared by an engineer based on average measurements previously captured over a broad stretch of the road (e.g., over an entire length of the road being constructed). The measurements can include an average texture of the underlying surface.

The rate of asphalt application required by the plan is electronically transferred into a distribution controller mounted on the spray truck. The controller monitors a travel speed of the truck along the road, and responsively adjusts operation of the pump such that an actual rate of discharge from the nozzles provides the planned rate along the length of the road.

While the conventional machine, control system and method discussed above may be adequate for some applications, it can also be less than optimal. For example, relying on only an average measurement of texture to determine the application rate for the entire road may result in over application in some areas and under application in other areas. In addition, the average texture measurements typically used to generate the plan may not consider all factors affecting performance of the road. Further, the conventional process for manually taking the texture measurements (e.g., using sand circles) and thereafter developing and implementing the plan may be slow, labor-intensive and expensive.

The disclosed machine, system and processes are directed to overcoming one or more of the problems set forth above and/or other problems of the prior art.

SUMMARY

In one aspect, the present disclosure is directed to a machine for use in building a road. The machine may include a vehicle, and a distribution arrangement mounted to the vehicle and configured to distribute a material onto a surface as the vehicle moves over the surface. The machine may also include at least one sensor mounted to the vehicle and configured to generate a signal indicative of a texture of the surface during movement of the vehicle over the surface, a locating device configured to detect a location of the texture, and a controller in communication with the distribution arrangement, the at least one sensor, and the locating device. The controller may be specially programmed to determine an amount of the material to be applied to the location of the texture based on the signal, and to automatically cause the distribution arrangement to distribute the amount of the material onto the surface at the location of the texture as the vehicle moves over the surface.

In another aspect, the present disclosure is directed to another road building machine. This road building machine may include a vehicle, and a distribution arrangement mounted at a trailing end of the vehicle and configured to spray an asphalt material through a plurality of nozzles onto a surface as the vehicle moves over the surface. The road building machine may further include a plurality of sensors mounted across a leading end of the vehicle and configured to generate signals indicative of textures of the surface during movement of the vehicle over the surface, wherein a number of the plurality of sensors is equal to a number of independently controllable groups of the plurality of nozzles. The road building machine may also include a locating device mounted to the vehicle and configured to detect locations of the textures, and a controller in communication with the distribution arrangement, the plurality of sensors, and the locating device. The controller may be specially programmed to determine amounts of the material to be applied to the locations of the textures based on the signals, and to automatically cause the distribution arrangement to distribute the amounts of the material onto the surface at the locations of the textures as the vehicle moves over the surface.

In another aspect, the present disclosure is directed to a distribution arrangement for a road building machine. The distribution arrangement may include a vessel configured to hold an asphalt material, a spray bar extending across a trailing end of the road building machine, and a pump configured to press the asphalt material from the vessel through the spray bar. The distribution arrangement may also include a plurality of nozzles in fluid communication with the spray bar and configured to spray the asphalt material onto a surface as the road building machine moves over the surface, and a plurality of valves configured to regulate flow of the asphalt material through the plurality of nozzles. The distribution arrangement may further include a plurality of sensors mounted across a leading end of the road building machine and configured to generate signals indicative of textures of the surface during movement of the road building machine over the surface. A number of the plurality of sensors is equal to a number of independently controllable groups of the plurality of nozzles. The distribution arrangement may further include a locating device mounted to the road building machine and configured to detect locations of the textures, and a controller in communication with the plurality of valves, the plurality of sensors, and the locating device. The controller may be specially programmed to determine an amount of the material to be applied to the locations of the textures based on the signals, and to automatically cause the plurality of valves to pass the amounts of the asphalt material through the plurality of valves and onto the surface at the locations of the textures as the road building machine moves over the surface.

DETAILED DESCRIPTION

The terms "about" and/or "generally" as used herein serve to reasonably encompass or describe minor variations in numerical values measured by instrumental analysis or as a result of sample handling. Such minor variations may be considered to be "within engineering tolerances" and in the order of plus or minus 0% to 10%, plus or minus 0% to 5%, or plus or minus 0% to 1%, of the numerical values.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Figure 1:
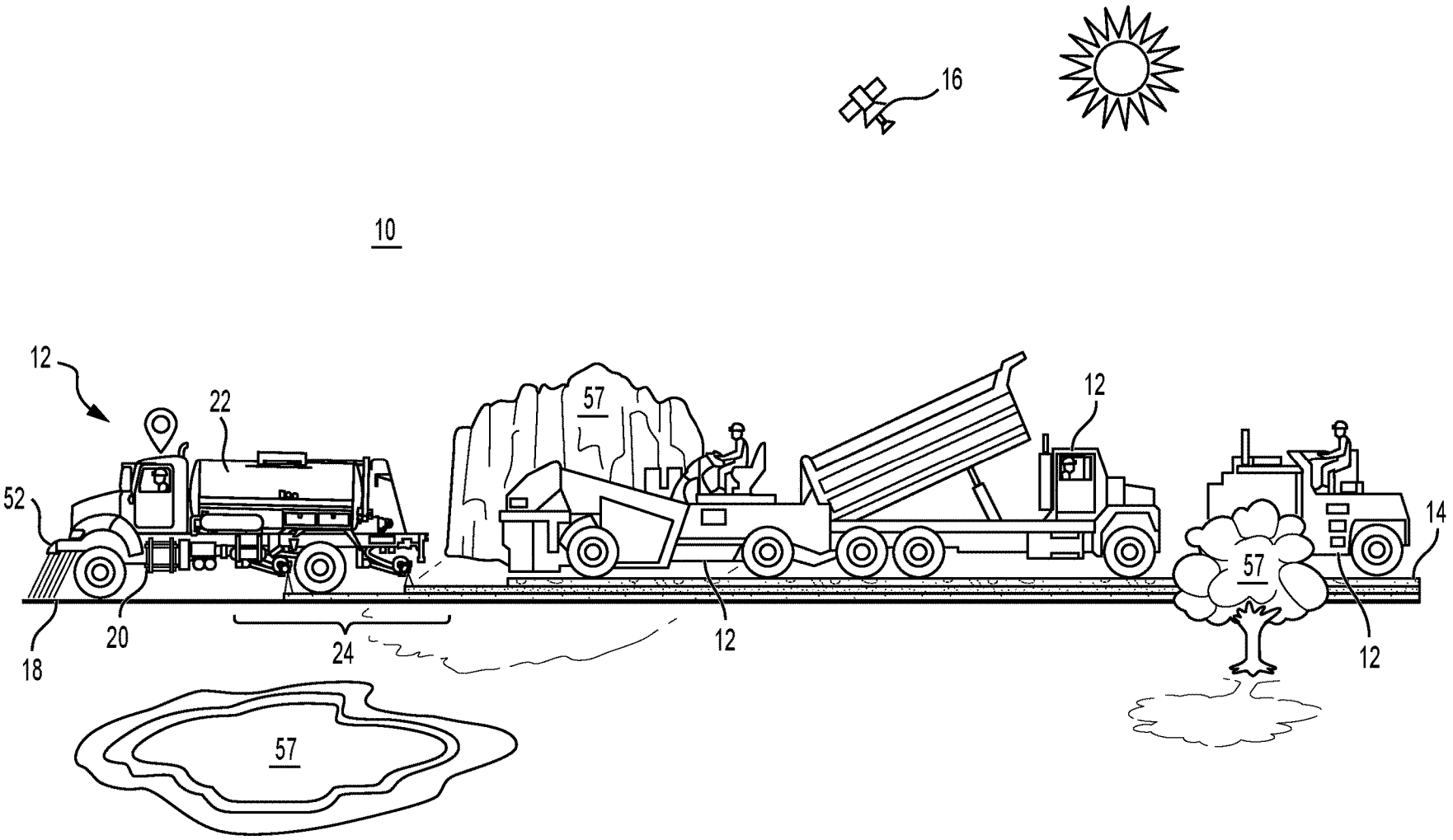
FIG. 1 is a diagrammatic illustration of example machines that may be used to build at least a portion of a road.

FIG. 1 illustrates a work environment 10, in which one or more machines 12 are performing a road-building operation. It should be noted that, while building of a new road 14 will be discussed in detail below, the concepts disclosed in this specification may be equally applicable to maintenance, rehabilitation and/or preservation of an existing road 14. As will also be explained in more detail below, a location, orientation, speed and/or trajectory of machine(s) 12 may be tracked (e.g., by a network of satellites 16) during the road-building operations.

Machine(s) 12 may be configured to apply one or more materials to an existing or newly prepared surface 18 to form, build up, treat and/or repair at least a portion of road 14. The material may include, for example, an asphalt material, an asphalt mixture (e.g., including an asphalt emulsion, liquid, or slurry and a diluent, additives, fillers, binders, polymers, catalysts, etc.), concrete, a concrete mixture, a priming material, a cure-enhancing material, a strengthening material, a dust-controlling and/or stabilizing material, aggregate, and/or another road material known in the art. It should be noted that, while machine(s) 12 will be described in detail as land-based machines, any one or more of the disclosed machine(s) 12 could embody a non-land based machine (e.g., an aerial drone) configured to perform the same or similar operations, if desired. It is also contemplated that the configurations of and/or operations disclosed as being performed by a single machine 12 could alternatively be distributed among multiple different machines 12. Likewise, it is contemplated that the configurations of and/or operations disclosed as being performed by multiple different machines 12 could alternatively be integrated into a lesser number of machines (e.g., one machine) 12.

FIG. 1 illustrates multiple machines 12 cooperating as a convoy to build up existing surface 18 and form new road 14. Various convoy arrangements are envisioned that together may form new road 14. In one specific example, the convoy consists of one or more distributors ("distributor"—left-most machine 12 illustrated in FIG. 1), followed by one or more aggregate spreaders ("spreader") that are supplied with aggregate by any number of different haul trucks, followed by one or more compactors (right-most machine 12 illustrated in FIG. 1). It is contemplated that the convoy could additionally include any number of surface-conditioning machines (e.g., milling machines, reclaiming machines, shaping machines, patching machines, etc.—not shown) that lead the distributor and condition surface 18 prior to the application of new material.

It should be noted that, while the remainder of this disclosure will focus on the distributor introduced above, many (e.g., some or all) of the disclosed concepts may be applicable to one or more other machine(s) 12 of the road-building convoy depicted in FIG. 1.

The distributor may include components that cooperate to apply one or more materials to surface 18. These components may include, among other things, a vehicle 20, one or more vessel(s) 22 supported by vehicle 20 and configured to hold the material(s), and a distribution arrangement ("arrangement") 24 configured to receive the material(s) from vessel 22 and distribute (e.g., spray) the material(s) onto surface 18 and/or road 14.

Vehicle 20 may, itself, be an assembly of components that supports and/or powers the other components/systems of machine 12. In the disclosed embodiment, these components may include a chassis, a power source mounted to the chassis, a drivetrain that is operatively connected to and driven by the power source, and one or more propulsion devices powered by the drivetrain. The power source may include any source known in the art for powering a vehicle. Example sources include an engine (e.g., a gasoline engine, a diesel engine, a gaseous fuel-powered engine, etc.), a battery, or a hybrid engine/battery configuration. Example drivetrains include a transmission, a driveline, a final drive, one or more electric motors, and/or a hybrid transmission/ final drive or electric motor configuration. Example propulsion devices include wheels, tracks, feet, fans, jets, blades, and/or propellers.

Figure 2:
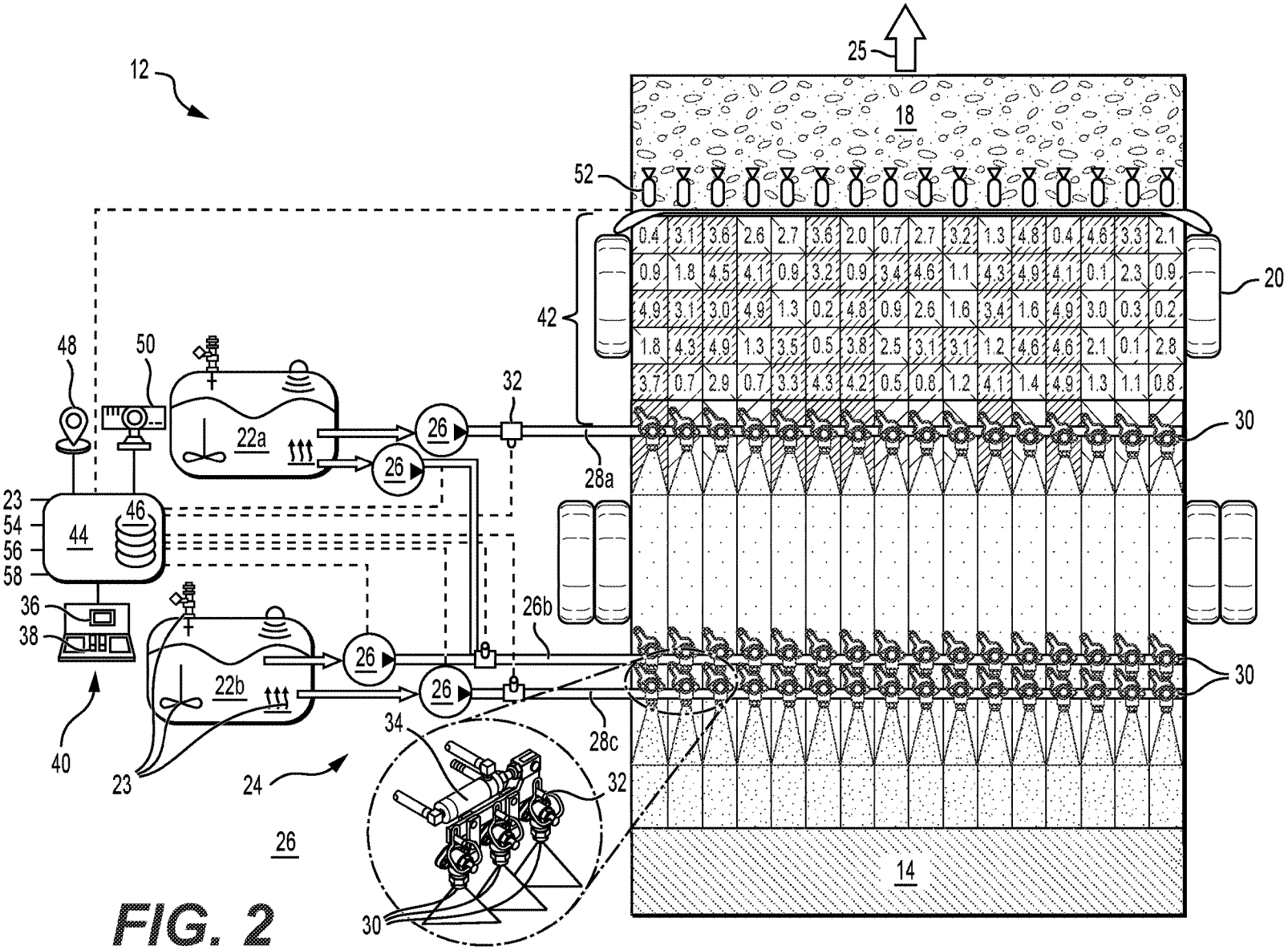
FIG. 2 is a diagrammatic illustration of an example system that may be used to control the machine(s) of FIG. 1.

The chassis of vehicle 20 may be configured to support vessel(s) 22 and distribution arrangement 24. In the disclosed embodiment, only a single vessel 22 is shown as being supported by the chassis. However, in some applications, multiple different materials may need to be separately discharged, simultaneously discharged and/or discharged together onto surface 18 and/or road 14. In these embodiments, more than one vessel 22 may be mounted to the chassis. For example, as shown in FIG. 2, a first vessel 22*a* may be configured to hold a first material (e.g., a priming emulsion), and a second vessel 22*a* may be configured to hold a second material (e.g., an asphalt mixture). In some embodiments, a catalyst (e.g., a hardener that reacts with the asphalt mixture) may be held within an additional third vessel (not shown). Each of these vessel(s) 22 may include an inlet to receive the material, an outlet to discharge the material, and any number of conditioning devices (e.g., mixers, agitators, heaters, coolers, recirculation circuits, sensors, valves, conduits, additive injectors, etc.) 23 that serve to condition the material inside of vessel(s) 22.

In the example of FIG. 2, arrangement 24 may include components mounted to the chassis of vehicle 20 that cooperate to selectively discharge the material from vessel(s) 22 onto surface 18 and/or road 14. The components may include, among other things, one or more pumps 26, one or more spray bars 28, and any number of nozzles 30.

Each pump 26 may be controlled to draw material from a corresponding vessel or vessels 22 and direct the material under pressure to a corresponding one or more spray bars 28. In multi-pump embodiments, pumps 26 may be arranged in parallel and independently controlled to provide a different flow rate and/or pressure of material to corresponding spray bars 28. Each pump 26 may be mechanically, hydraulically, pneumatically, and/or electrically driven by the power source of vehicle 20 (or another source, for example a chassis-mounted auxiliary power unit—not shown). In some embodiments, one or more of pumps 26 can be regulated somewhat or completely independent of the vehicle power source (e.g., an electrically powered pump may operate independent of speed and/or torque outputs of the power source) to provide a variable (e.g., infinitely variable) flowrate and/or pressure. In these embodiments, pumps 26 may be rate- and/or pressure-regulated via a command directed to the corresponding pumps and/or associated motors (not shown) driving the pumps 26.

Spray bar(s) 28 may be arranged lengthwise across a partial or full width of vehicle 20 (e.g., at a leading end, at a trailing end, and/or at a point between the leading and trailing ends, relative to a normal or forward travel direction represented by an arrow 25 illustrated in FIG. 2). Spray bars 28 may be fluidly connected to receive the pressurized material from pump(s) 26. If multiple spray bars 28 are included, they may be arranged in series or in parallel and configured to conduct the same or different materials to their associated nozzle(s) 30.

In the disclosed embodiment shown in FIG. 2, a first spray bar 28*a* is fluidly connected to vessel 22*a* and located at the leading end or a midpoint of vehicle 20 (e.g., in front of front tires or between front and rear tires). Spray bar 28*a* may be configured to conduct the priming emulsion from vessel 22*a* to the nozzles 30 associated with spray bar 28*a*.

In the same example of FIG. 2, at least one spray bar 28 (e.g., a second spray bar 28*b* and a third spray bar 28*c*) may be fluidly connected to vessel 22*b* and located at the trailing end of vehicle 20 (e.g., behind the rear tires). Spray bars 28*b*, 28*c* are shown as being both configured to conduct an asphalt mixture from vessel 22*b* to the nozzles 30 associated with spray bars 28*b*, 28*c*. A distance between spray bar 28*a* and spray bars 28*b*, 28*c* may be selected to allow the priming material sprayed by nozzles 30 of spray bar 28*a* to penetrate surface 18 and/or to attain another prerequisite (e.g., to partially or fully dry) before the asphalt mixture is sprayed onto the priming material by nozzles 30 of spray bars 28*b*, 28*c*.

In the example of FIG. 2, multiple spray bars 28 are utilized at the trailing end of vehicle 20 for several reasons. First, a greater volume of material may be discharged via utilization of multiple spray bars 28. Second, a greater flexibility in control over the spraying of the material may be available. For example, each of spray bars 28*a*, 28*c* could be supplied with material via a single pump 26 and have a similar flowrate and/or pressure or be supplied with material via separate pumps 26 that have different flowrates and/or pressures. In either embodiment, spray bar 28*b* could be utilized alone, spray bar 28*c* could be used alone, or spray bars 28*b* and 28*c* could be activated together to provide an even greater range of flow rates and/or pressures.

It should be noted that spray bars 28*b*, 28*c* could alternatively be associated with different vessels 22 and be configured to conduct different materials to their corresponding nozzles 30, if desired. For example, spray bar 28*b* may conduct the asphalt mixture from vessel 22*b*, while spray bar 28*c* may trail spray bar 28*a* and conduct a different material (e.g., a chemical catalyst, heated air, etc.) that affects the way (e.g., a speed) that the asphalt mixture cures and/or hardens ("bricks"). The cure-enhancing material may be sprayed onto surface 18 at the same time as or after the asphalt material is sprayed. For example, the material from spray bar 28*b* may pass through the material spraying from spray bar 28*c*, such that the two materials mix in the air prior to coating surface 18 and/or mix just as they coat surface 18.

In some embodiments, when multiple spray bars 28 are included, each spray bar 28 may discharge material to a separate segment across the width of vehicle 20 or to overlapping or common segments. For example, spray bars 28 may be arranged end-to-end or in adjacent (e.g., overlapping) rows. In one particular embodiment, a first spray bar 28 extends across the entire width, while an additional one or more spray bars 28 overlap the first spray bar 28 and extends only across a partial width (e.g., only across wheel path or seam areas).

Each spray bar 28 may function as a manifold for the corresponding nozzles 30 fluidly receiving material therefrom. In one particular embodiment, forty-eight nozzles 30 are distributed along the length of each spray bar 28 and across the width of vehicle 20. In this embodiment, a length of each spray bar 28 is sixteen feet, such that vehicle 20 has a nozzle density of three nozzles per foot. It is contemplated, however, that the number of nozzles 30 and/or the length of each spray bar 28 could be different.

Any type, size, and/or configuration of nozzle 30 may be utilized in conjunction with arrangement 24. In some embodiments, multiple types/sizes, and/or configurations of nozzles 30 may be utilized at the same time. It is also contemplated that nozzles 30 may be selectively swapped out for nozzles 30 of different types, sizes and/or configurations to provide a different rate and/or profile of material application.

Nozzles 30 may be independently regulated, regulated all together, or regulated in groups, as desired. For example, one or more valves 32 may be associated with each spray bar 28, each nozzle 30, or different groupings of nozzles 30. Valve 32 may be any type of valve known in the art for regulating a flow of pressurized material. In the example of FIG. 2, valve 32 is a poppet-style valve associated separately with each nozzle 30, and the flow/pressure of material supplied to each nozzle 30 is regulated via operation of the corresponding pump and/or another valve (e.g., a butterfly valve) associated with spray bar 28. Each nozzle 30 may be controlled to spray a desired amount of material within a given period of time based on the pressure of the material within spray bar 28, how often the poppit valve is opened, how far the poppit valve is opened, and/or how long the poppit valve remains open. When nozzles 30 are regulated in groups, an actuator 34 (e.g., a pneumatic cylinder, an electric solenoid, a hydraulic pilot, etc.) may be associated with multiple valves 32 to synchronize their openings/closings.

In some embodiments, nozzles 30 may be dynamically adjustable. For example, nozzles 30 may be rotated and/or shifted (e.g., side-to-side) to adjust a spray angle, spray area, spray orientation, and/or spray overlap. In these embodiments, an additional rotary and/or linear actuator (not shown) may be associated with each nozzle 30 or grouping of nozzles 30.

It is contemplated that spray bars 28, together with their associated nozzles 30, may also or alternatively be dynamically adjustable. For example, spray bars 28 may be extended, folded, tilted, and/or separately deployed to adjust a width, depth, and/or overlap of spray areas. Any number/type of actuators and any configuration of motions platforms (e.g., hinges, sliding carriages, linkages, etc.) may be used to facilitate these motions.

In some applications (e.g., the application shown in FIG. 1), vehicle 20 may also include an operator station housing informational devices 36 (shown in FIG. 2) and/or control devices 38 usable by a human operator to regulate vehicle 20 and/or distribution arrangement 24. Example informational devices 36 may include, among other things, a display screen, a speaker, a visual indicator (e.g., a light indicator, a dial indicator, a level indicator, etc.), a tactile device (e.g., a seat rumbler or stick vibrator), etc. Example control devices 38 may include, among other things, a joystick, a steering wheel, a pedal, a switch, a button (e.g., a virtual button on a display screen or a physical button), a lever, a keyboard, a mouse, a key, etc. Information about machine 12 may be relayed to the operator via informational devices 36, and control instructions or commands for machine 12 may be received from the operator via control devices 38.

It is contemplated that the operator station of machine 12 may be omitted, in some applications. For example, machine 12 could be at least partially controlled in a remote and/or autonomous manner. In these applications, the operator station may be minimized, located remotely (e.g., offboard vehicle 20), and/or completely omitted. In other applications, machine 12 could embody a trailer towed behind another vehicle. In this latter example, the operator station may be mounted on the other vehicle and used to monitor and control operations occurring on and/or performed by the trailer.

As also shown in FIG. 2, a control system ("system") 40 may be associated with machine 12 and configured to regulate one or more operations of machine 12 in an automated or semi-automated manner. For example, system 40 may be configured to generate a plan for building road 14, and also regulate distribution of the road material(s) contained in vessel(s) 22 onto surface 18 according to the plan for road 14 (e.g., while machine 12 travels along surface 18). As will be explained in more detail below, the plan may include segmentation of surface 18 into multiple separate areas that require different application rates (e.g., material layer thicknesses) and/or types of road material(s). System 40 (e.g., a controller 44 of system 40) may interact with any number of acquisition devices to acquire information about surface 18, the material(s) to be applied and/or being applied to surface 18, environment 10, and specifications for road 14. System 40 (e.g., controller 44) may receive, generate and/or modify the plan for road 14 based on the acquired information. System 40 (e.g., controller 44) may then regulate any number of control devices to ensure that machine 12 distributes the material(s) according to the plan.

Controller 44 may include, among other things, one or more processors, any number of input/output ("I/O") devices, and one or more memories for storing programs and data. The programs may include, for example, any number of planning and/or paving apps and an operating system.

Each of the processor(s) may be a single or multi-core processor configured with virtual processing technologies, and specially programmed with logic to simultaneously execute and control any number of operations. The processor(s) may be configured to implement virtual machine technologies, machine learning technologies, artificial intelligence, neural networks, machine logic, and/or other known technologies to execute, control, run, manipulate, analyze and/or store any number of software modules, applications, programs, etc. In addition, in some embodiments, the processor(s) may include one or more specialized hardware, software, and/or firmware modules (not shown) specially configured with particular circuitry, instructions, algorithms, and/or data to perform functions of the disclosed methods. It is appreciated that other types of processor arrangements could be implemented that provide for the capabilities disclosed herein.

The memory can be a volatile or non-volatile, magnetic, semiconductor, tape, optical, removable, non-removable, or other type of storage device or tangible and/or non-transitory computer-readable medium that stores one or more executable programs, such as analysis, planning and/or paving apps and the operating system. Common forms of non-transitory media include, for example, a flash drive, a flexible disk, a hard disk, a solid state drive, magnetic tape or other magnetic data storage medium, a CD-ROM or other optical data storage medium, any physical medium with patterns of holes, a RAM, a PROM, an EPROM, a FLASH-EPROM or other flash memory, NVRAM, a cache, a register or other memory chip or cartridge, and networked versions of the same.

The memory may store instructions that enable the processor(s) to execute one or more applications, such as the analysis, planning and/or paving apps, the operating system, and any other type of application or software known to be available on computer systems. Alternatively or additionally, the instructions, application programs, etc. can be stored in an internal and/or external database (e.g., a cloud storage system—not shown) that is in direct communication with controller 44, such as one or more databases 46 or memories accessible via one or more networks (not shown). The memory can include one or more memory devices that store data and instructions used to perform one or more features of the disclosed embodiments. The memory can also include any combination of one or more databases controlled by memory controller devices (e.g., servers, etc.) or software, such as document management systems, Microsoft SQL databases, SharePoint databases, Oracle™ databases, Sybase™ databases, or other relational databases.

In some embodiments, controller 44 is communicatively connected to one or more remote memory devices (e.g., remote databases—not shown) through a network (not shown). The remote memory devices can be configured to store information that controller 44 can access and/or manage. By way of example, the remote memory devices could be document management systems, government databases (e.g., a geographic information system—GIS, a spectral signature library such as the USGS library, digital elevation models, land cover/use maps, etc.), and private libraries and databases (e.g., Microsoft SQL database, SharePoint databases, Oracle databases, Sybase databases, Cassandra, HBase, or other relational or non-relational databases or regular files). Systems and methods consistent with disclosed embodiments, however, are not limited to separate databases or even to the use of a database.

The programs may include one or more software or firmware modules causing the processor(s) to perform one or more functions of the disclosed embodiments. Moreover, the processor(s) can execute one or more programs located remotely from controller 44. For example, controller 44 can access one or more remote programs that, when executed, perform functions related to disclosed embodiments. In some embodiments, the programs stored in the memory and executed by the processor(s) can include one or more of the analysis, planning, and/or paving apps and the operating system. The apps may cause the processor(s) to perform one or more functions of the disclosed methods.

The operating system may perform known operating system functions when executed by one or more processors of controller 44. By way of example, the operating system may include Microsoft Windows, Unix, Linux, OSX, IOS, Raspberry Pi OS (e.g., Rapbian), Android, or another type of the operating system. Accordingly, disclosed embodiments can operate and function with computer systems running any type of the operating system.

The I/O devices may include one or more interfaces (e.g., informational and/or control devices 36, 38) for receiving signals or input from a user (e.g., an operator of machine 12, an observing technician, a remote engineer, etc.), and for providing signals or output to the user and/or machine 12 that allow road 14 to be built.

The analysis, planning and/or paving apps may cause controller 44 to perform methods related to generating, receiving, processing, analyzing, storing, and/or transmitting data in association with operation of machine 12 and corresponding analysis/planning/paving of road 14. For example, the apps may be able to configure controller 44 to perform operations including: receiving instructions from an engineer of road 14 regarding specifications, materials to be used, desired characteristics, and/or desired performance of road 14; capturing sensory data associated with machine 12, surface 18, the environment, and/or the materials; receiving control instructions from the operator and/or the user of machine 12 during operation; processing the instructions, specifications, characteristics, performance criteria, sensory data and control instructions; generating one or more possible plans for building road 14; analyzing and/or optimizing the plans; providing recommendations of one or more plans; controlling machine 12 to build road 14 via a recommended and/or selected plan; analyzing the building of road 14 in real or near-real time; and/or providing feedback and adjustments to machine 12 for improving current and/or future building operations.

The input and output devices useable by controller 44 during planning and/or building of road 14 may be standalone devices or devices that are embedded within, mounted on, and/or otherwise associated with machine 12. As shown in FIG. 2, the input devices may include, among other things, one or more location input devices 48, one or more environment input devices 50, one or more (e.g., a plurality of) surface input devices 52, one or more machine input devices 54, and one or more distribution input devices 56.

Location input device(s) 48 may include any number of mechanisms configured to generate location data indicative of a geographical position, orientation, heading, speed, and/or acceleration of machine 12 relative to a local reference point, a coordinate system associated with environment 10, a coordinate system associated with Earth, or any other type of 2-D or 3-D coordinate system.

In one application, an example location input device 48 embodies an electronic receiver configured to communicate with satellite(s) 16 (referring to FIG. 1) or a local radio or laser transmitting system (not shown) and used to determine a relative geographical location of itself. This location input device 48 may receive and analyze high-frequency, low-power radio or laser signals from multiple locations to triangulate a relative 3-D geographical position and orientation. In some embodiments, location input device 48 may also be configured to determine a location and/or orientation of a particular part of machine 12 (e.g., of distribution arrangement 24, each spray bar 28, each nozzle 30, each area being sprayed with material, each device 52, each area being scanned by each device 52, etc.). Based on signals generated by location input device(s) 48 (i.e., based on the location data) and based on known kinematics of machine 12, controller 44 may be able to determine in real or near-real time the position, heading, travel speed, acceleration, and/or orientation of machine 12 and/or any system component mounted to machine 12, relative to one or more areas of surface 18.

In another application, an example location input device 48 embodies one or more powertrain sensors (e.g., an odometer, a speedometer, a tachometer, a transmission or final drive sensor, a steering sensor, etc.) associated with machine 12 and configured to track a distance, speed, acceleration, trajectory, and/or travel time along surface 18 from a known starting point. Based on signals generated by this/these input device(s) 48, controller 44 may again be able determine in real or near-real time the position, heading, travel speed, acceleration, and orientation of machine 12 and/or system component relative to the area(s) of surface 18.

In yet another application, an example location input device 48 embodies a camera mounted to machine 12 and configured to capture images of surface 18 and/or the environment around surface 18. In this example, controller 44 may be programmed with image recognition software that allows controller 44 to determine the position, heading, travel speed, acceleration and/or orientation of machine 12 and/or system component relative to the area(s) of surface 18.

Environment input device(s) 50 may include any number of devices configured to generate environmental data indicative of an environmental condition affecting distribution, curing, and/or performance of the material used to build road 14. In one application, an example environment input device 50 embodies a camera mounted to machine 12 and configured to capture images of the environment around surface 18. In this example, controller 44 may be programmed with image recognition software and/or algorithms that allow controller 44 to determine geological features 57 (shown in FIG. 1) on and/or around surface 18 based on recognized images. These features may include, for example, a grade in a length direction of surface 18, a contour (e.g., wheel ruts, potholes, crowning, etc.) in a width direction of surface 18, a feature (e.g., a berm, cliff, tree, mountain, building, etc.) that casts a shadow over surface 18, a feature (e.g., a body of water, a ravine, etc.) that generates humidity or lowers air temperature around surface 18, etc.

In another application, an example environmental input device 50 includes a sensor (e.g., an accelerometer, a light sensor, an acoustic sensor, etc.) that is configured to gather environmental data (e.g., grade, sun exposure or shadowing intensity, surface contours or roughness, etc.) associated with surface 18 and/or the environment surrounding surface 18 during travel of machine 12 along surface 18.

Surface input device(s) 52 may include any number of devices configured to generate surface data indicative of a condition of surface 18 affecting how well the material to be applied by machine 12 will adhere to surface 18 and/or perform over the life of road 14. In the disclosed embodiment, multiple input devices 52 are illustrated in FIGS. 1 and 2 as being arrayed across the leading end of vehicle 20. In this embodiment, the number of input devices 52 may be equal to the number of independently controllable groupings of nozzles 30 across the width of vehicle 20. For example, for the configuration of vehicle 20 described above that is equipped with sixteen controllable subsets of nozzles 30, sixteen independent input devices 52 may be located to separately scan one-foot segments across the width of vehicle 20 at the leading end. For greater scan resolution and material application control, vehicle 20 may be equipped with the same number of input devices 52 as the number of independently controllable nozzles 30 (e.g., forty-eight input devices 52 to match forty-eight nozzles 30, each having a spray width of four inches).

It should be noted that, while input devices 52 are shown and described as being located at the leading end of vehicle 20 (e.g., in front of the front tires), input devices 52 may be located closer to spray bar(s) 28 (e.g., behind the front tires), if desired. A further distance between input devices 52 and spray bar(s) 28 may result in a cleaner environment for input devices 52. However, the greater distance may also result in a greater amount of time elapsed since a particular segment of surface 18 is scanned and subsequently sprayed with material. As will be explained in more detail below, this time should be accounted for when using input devices 52 and nozzles 30 in a real or near-real time application.

In one application, an example surface input device 52 includes a texture sensor configured to generate a signal indicative of a texture of surface 18. The texture sensor may embody a LIDAR sensor (e.g., using a point cloud generator), a RADAR sensor, a sound (e.g., ultrasound) sensor, an inductive sensor (e.g., using a resonant inductive circuit), a capacitive sensor (e.g., using an oscillating signal generator), a laser sensor (e.g., using time-of-flight information), or another type of sensor that generates a signal indicative of a height from the sensor to uppermost boundaries of surface 18. In this application, a change and/or a change rate in the height (i.e., a relative difference in terrain level) detected by input device(s) 52 may correspond with a texture at a specific location on surface 18.

In another application, an example surface input device 52 may include an accelerometer or acoustic sensor configured to generate signals indicative of vibrations induced within machine 12 (e.g., via the tires of vehicle 20) because of varying textures of surface 18. These vibrations (e.g., accelerations and/or noise traces) may then be related by controller 44 to relative differences in terrain level.

In yet another application, an example surface input device 52 may include a camera configured to capture images of the uppermost boundaries discussed above. Controller 44 may then be configured to directly measure the relative differences in terrain level from the images.

Machine input device(s) 54 may include any number of devices configured to generate data indicative of operating condition(s) of machine 12 that affect planning, monitoring and/or controlling of the road building process. These devices may include any number of sensors configured to detect a powertrain operation (e.g., an engine rpm, a transmission gear or rpm, a hydrostatic pressure of a power-takeoff driving pump 26, a rotational speed of a tire or final drive, a steering angle, a speed of surface 18 passing below machine 12, etc.).

Distribution input device(s) 56 may include any number of devices configured to generate data indicative of operating condition(s) of distribution arrangement 24 that affect monitoring and/or controlling of the road building process. These devices may include sensors configured to detect a parameter associated with the material in vessel 22, a parameter associated with operation of pump 26, a parameter associated with spray bar(s) 28, a parameter associated with nozzles 30, etc. and to generate corresponding signals. The parameters may include, among other things, an amount of material remaining in vessel 22; a temperature and/or viscosity of the material; an rpm, a displacement, a flowrate and/or a pressure of pump 26; a temperature, a flowrate and/or a pressure inside of spray bar(s) 28; a temperature, a flowrate, a pressure, a spray area, settings (e.g., diameters, angles, orientations, etc.), etc. of nozzles 30; an activation status of any of these and other components (e.g., of valves 32 and/or actuators 34); and other parameters known in the art.

In some embodiments one or more additional sensors 58 may be associated with the convoy of machines 12 illustrated in FIG. 1—but not mounted on or otherwise associated with the same machine (e.g., not associated with the distributor) 12 discussed above. For example, a material (e.g., aggregate) sensor 58 may be associated with the machine(s) 12 trailing behind the distributor. In one example, sensor 58 is associated with the aggregate spreader. In another example, sensor 58 is associated with a haul truck that delivers aggregate to the spreader. In either situation, sensor 58 may be configured to generate one or more signals indicative of a shape, size, and/or amount of aggregate delivered to and/or spread by the spreader. Sensor 58 may be, for example, a camera, a LIDAR sensor, a RADAR sensor, a laser sensor, or another type of sensor known in the art. The signals may be directed (e.g., wirelessly) to controller 44 for further processing.

The signals generated by devices 23, 36, 38, 48, 50, 52, 54, 56 and 58 may be indexed according to time and/or location, and used for planning, road building, and/or reporting purposes. The signals may be generated during traversal of surface 18 by a machine 12 (e.g., the distributor or another machine 12) before the application of any material by the distributor or another machine 12; during the application of material by the distributor or another machine 12 in real or near-real time; and/or after the application of material by the distributor or another machine 12. The signals may be directed (e.g., wirelessly or via wired means) to controller 44 for processing.

It should be noted that similar devices may be used to generate the same signals for different purposes and/or different signals for different purposes. In these situations, it is contemplated that system 40 could include multiple separate devices that are similar or the same, or that the different functionalities could be performed by common devices. It is also contemplated that instead of, or in addition to, measuring all of the different parameters discussed above, one or more of these parameters may be pulled from a local or remote database (e.g., from database 46) based on the detected and/or known position and/or orientation of machine 12. For example, geographical data, climate data, weather data, historical traffic data, previous road deterioration and/or performance data, and other related parameters could have been measured, modeled, and/or calculated at a previous time and stored within database 46 that is accessible by controller 44. In this way, arrangement 24 may be simplified and/or produced at a lower cost.

Any number of output devices may be under the regulation of controller 44 to affect data collection, planning, and/or operation of machine 12 and arrangement 24. These devices may include, among other things, the conditioning devices 23 associated with vessel 22 and/or distribution bar(s) 28; pumps 26; nozzles 30; valves 32 and/or other metering devices disposed at various locations within arrangement 24; actuators 34; the powertrain (e.g., engine fuel regulators, transmission gear regulators, steering actuators, etc.) of vehicle 20; etc.

In some embodiments, the input and/or output devices may, themselves, include one or more processors (e.g., a programmable logic control (PLC), a computer numeric controller (CNC), etc.), a memory, and/or a transceiver. When these devices are equipped with a dedicated processor and memory, the dedicated processor may be configured to execute instructions stored on the memory to receive commands from the processor(s) associated with video, audio, other sensory data, control data, location data, etc., including capture commands, processing commands, motion commands, and/or transmission commands. The transceiver may include a wired or wireless communication device capable of transmitting data to or from one or more other components in system 40. In some embodiments, the transceiver can receive data from the processor(s), including instructions for sensor and/or actuator activation and for the transmission of data via the transceiver. In response to the received instructions, the transceiver can packetize and transmit data between the processor(s) and the other components.

Figure 3:
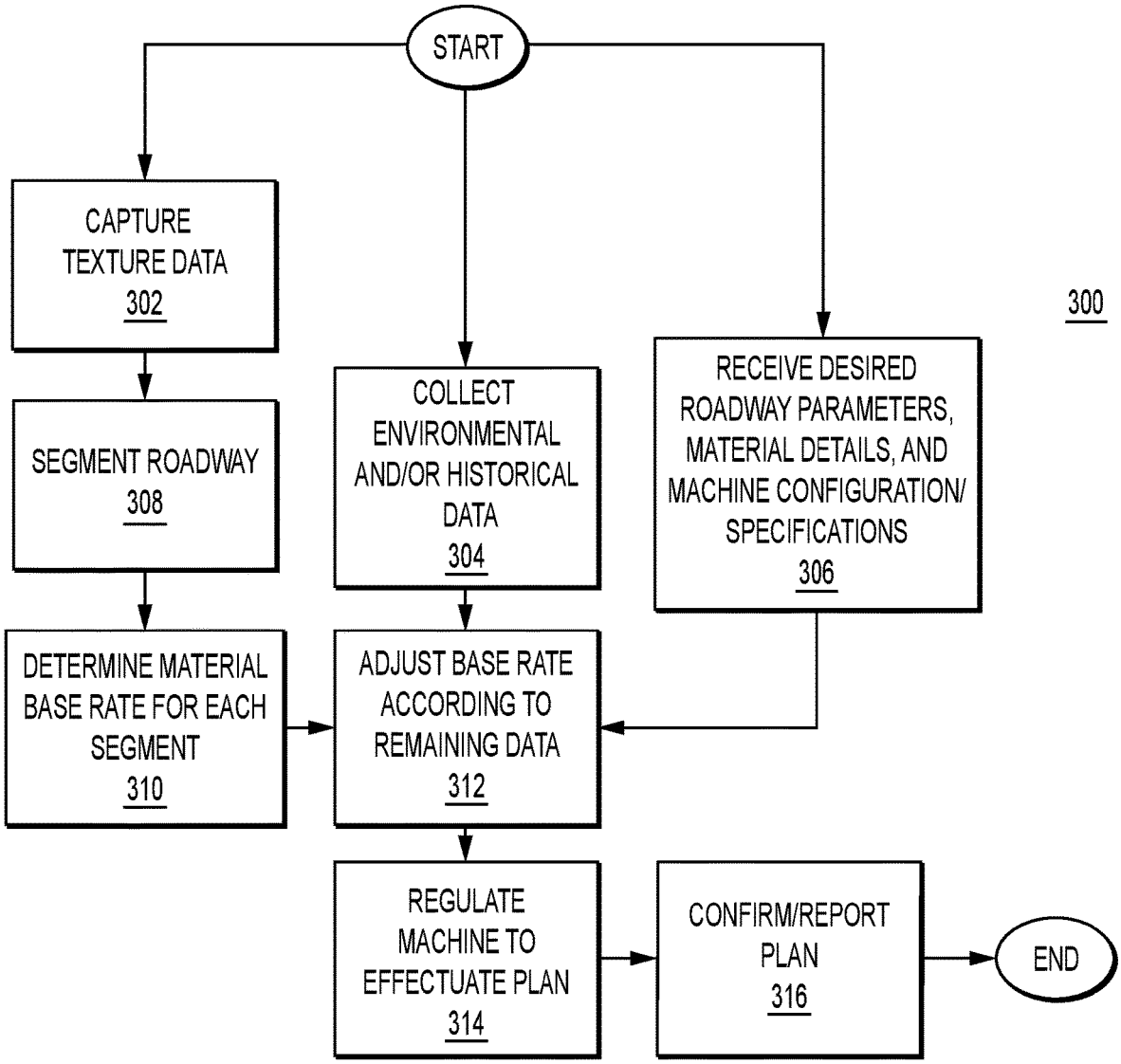
FIG. 3 is a flowchart of an example method that may be implemented by the system of FIG. 2 using the machine(s) of FIG. 1.

FIG. 3 is a flowchart depicting an example method that may be implemented by controller 44 during preparation, planning, application, and/or quality control processes performed by machine 12. FIG. 3 will be discussed in detail in the following section to further illustrate the disclosed concepts.

INDUSTRIAL APPLICABILITY

The disclosed machines, system and methods may improve the building and performance of roads. For example, the roads may be built safer, faster, cheaper, and better using the disclosed machines, system and methods. Operation of the disclosed machine(s), control system and method(s) will be described in detail below, with reference to FIGS. 1-3. It should be noted that the methods (e.g., the method of FIG. 3) may be implemented in whole or in part by controller 44. Alternatively, the methods may be implemented in whole or in part by a separate device that is configured to communicate with controller 44 and/or another processor located onboard or offboard machines 12. Accordingly, while the steps described below will be referenced as performed by controller 44, this reference is intended to describe any one or more of the above-mentioned processors.

As shown in the example method 300 of FIG. 3, at a start of a road building process, various information may be collected and/or received by controller 44. For example, information may be collected about surface 18 on which road 14 is to be built (Step 302), information may be collected about environment 10 surrounding surface 18 and/or about a history of surface 18 and/or a previous road at the intended location of new road 14 (Step 304), and information may be received about road 14 that is to be built (Step 306).

In the disclosed embodiment, the information collected at Step 302 may include, among other things, a texture of surface 18. For the purposes of this disclosure, the texture of surface 18 may be defined as a measured deviation in height of surface 18 (e.g., from a theoretical or ideal contour or plane, from an average texture across the width of surface 18, etc.). The contour, if non-planar, may be defined by an engineer responsible for designing road 14. In some embodiments, the contour may have a crown shape.

The texture of surface 18 may be collected via any one or more of the example input devices described above and/or other devices known in the art. The texture may be collected via these devices during travel of the distributor (or another machine 12) along surface 18 before the application of any material, during the application of material (e.g., in real or near-real time), and/or after the application of material. Additionally or alternatively, the texture may be downloaded from one or more local and/or remote databases 46. Likewise, any texture data that is newly collected may be uploaded to the same or different databases 46.

For example, during a travel pass along a finite length of surface 18, surface input device(s) 52 may scan a transverse swath (e.g., a point, multiple points, a line, and/or an area) of surface 18 at a location in front of, below, and/or behind machine 12, and generate one or more texture signals indicative of the texture of surface 18 across the swath. These signals may be indexed according to a transverse location within the array at which each device 52 is performing the scanning (e.g., within the first foot, second foot, third foot, etc., across the sixteen-foot width of machine 12), as well as a location along a length of surface 18. In some embodiments, coordinates (e.g., one, two, or three-dimensional coordinates) generated by device 48 at the same time that texture scanning is occurring may be stored together with each signal generated by each corresponding device 52. It is contemplated that the texture signals may additionally be indexed according to date and/or time, if desired. Controller 44 may receive these signals, analyze the signals, process the signals, store the signals and/or processing, and/or build a virtual texture map associated with the area being scanned.

An example texture map 42 generated by controller 44 is illustrated in FIG. 2 (e.g., on surface 18, between the front wheels of vehicle 20). As shown in FIG. 2, values representative of the texture of surface 18, as generated by input devices 52 and/or analyzed/processed by controller 44, may be placed into map 42 based on the corresponding coordinates discussed above. In the example map 42, sixteen data points have been entered into each row of map 42. Each data point may represent an area having a width of about one foot, and a dimension in the length of surface 18 of a predetermined amount (e.g., an amount equal to a spray diameter of nozzle 30). Additional rows of map 42 may be populated as machine 12 advances along the length of surface 18. Each column of map 42 may correspond with a particular input device 52 and also particular spray area of an individual nozzle 30 or of a grouping of nozzles 30 that are independently controlled.

In one embodiment, the data points entered into each cell of the virtual map described above and shown in FIG. 2 are actual textural measurements, as produced by input devices 52. In another embodiment, the data points are represented as deviations from a nominal value. The nominal value may be, for example, a value set by a user of system 40 (e.g., a value associated with the theoretical plane or contour discussed above). Alternatively, the nominal value may be a value calculated as an average of texture measurements taken for each cell, each row, for multiple rows, for a finite length and/or area of surface 18, for an entire length and/or area of surface 18, or for another data range specified by the user. Other strategies may also be employed.

The environmental information collected at Step 304 may include, for example, geographical information, climate information, weather information, and/or traffic information. The geographical information may include, among other things, information about geographical features under, on, and/or adjacent surface 18 that could affect the building and/or performance of road 14. This may include, for example, an orientation and/or distance of surface 18 relative to the sun or a known wind-flow pattern (e.g., direct exposure, indirect exposure, no exposure); the location of a feature (e.g., a cliff, tree, water body, etc.) 57 that might block sun exposure, increase humidity, or function as a heat sink; a grade of surface 18 relative to a known traffic flow (e.g., uphill or downhill, with or against travel) or area of interest (e.g., a mall, a school, etc.); an altitude; etc. Climate information may include historical temperatures (e.g., highs, lows, averages, swings, durations, etc.); humidity levels; precipitation amounts and forms; wind speeds, durations, and/or patterns; traffic patterns, volumes and/or densities; etc. Weather information may include conditions (e.g., any of the above-mentioned parameters) anticipated and/or actually experienced at a time of road building (e.g., historical road building and/or current road building). The information may be collected via any one or more of the example input devices described above and/or other devices known in the art. The information may be collected via these devices during travel of the distributor (or another machine 12) along surface 18 before the application of any material and/or during the application of material (e.g., in real or near-real time during material discharge from distribution arrangement 24). Additionally or alternatively, the geographical, climate, weather, and/or other GIS information may be pulled from one or more local and/or remote databases 46.

For example, during a travel pass along a finite length of surface 18, input device 50 may capture images of an area in front of, behind, above, below, and/or to the sides of machine 12 and generate one or more signals indicative of the geography of surface 18 and/or the environment 10 surrounding surface 18. These signals may be indexed according to a location at which device 50 is performing the image capture (e.g., based on signals from device 48) and/or according to date and/or time. At the same or a different date and/or time, one or more additional devices may generate one or more signals indicative of the temperature, humidity, light intensity, wind speed, wind direction, etc. associated with the weather at the time of material application and/or under conditions that should be similar to the conditions expected at the time of road building. Additionally or alternatively, historical information regarding the climate of environment 10 may be downloaded from local and/or remote databases 46. These signals and/or information may be directed to and/or pulled by controller 44 for processing.

The road history data collected at Step 304 may include, among other things, parameters (e.g., material formulas, mixtures, layer numbers, layer thicknesses, aggregate specifications, temperatures, distribution rates, corresponding coordinates, weather conditions during past building events, contractor identification, etc.) historically used to build previous roads and corresponding historical performance of the previous roads at the same location of the new road 14. The historical performance may include, among other things, information about repairs that have been made, maintenance activities that occurred, how often the road was plowed or sealed, reports of vehicular damage caused by road degradation, and/or observed failures (e.g., unraveling)—along with corresponding coordinates, dates and/or times.

The road information collected at Step 306 may include, for example, specifications for surface 18, road 14, and/or the materials (e.g., material formula, temperature and/or viscosity; aggregate size, shape, amount; etc.); machines 12 and/or processing parameters to be used in building road 14; etc. Although this information may typically be collected from an engineer responsible for the design of road 14 and/or applicable regulatory agencies (e.g., downloaded from local and/or remote databases 46 housing such information), it is contemplated that this information may additionally or alternatively be generated during road building, if desired. For example, while a type and/or size of aggregate may be specified for use in building road 14, it is contemplated that the type and/or size of aggregate actually being used may be different and detectible during application (e.g., in real or near-real time) via one or more of the input devices (e.g., sensor 58) described above.

It should be noted that Steps 302-306 may be performed simultaneously, or sequentially in any order. Further, Steps 304 and/or 306 may be performed after Step(s) 308 and/or 310 (yet to be described), if desired.

In some embodiments, after completion of at least Step 302, controller 44 may be configured to divide surface 18 into one or more virtual segments (see areas of common shading within map 42 of FIG. 2). In some embodiments, the dividing may be performed based on an area scannable by each device 52 (e.g., based on an average texture value measured within each scannable area). In other embodiments, the dividing may be performed based on a minimum area of resolution possible with nozzle(s) 30. In other embodiments, the scannable area and the minimum area of resolution may both be considered.

The overall range of textures measured and/or range of deviations from averaged or normalized values entered into map 42 may be divided into any number of subranges. The number of subranges may be based on a number of discrete application rates possible and/or desirable via arrangement 24. In the example of FIG. 2, the overall range of detectable values is 0.0 to 5.0 mm, and the number of subranges is selected to be three. The three different subranges in the example of FIG. 2 include a first subrange (0.0 to 1.0 mm), a second subrange (1.0 to 3.0 mm), and a third subrange (3.0 to 5.0 mm). Each cell within map 42 may then be designated generally as falling into subrange I, subrange II, or subrange III and represented within map 42 (e.g., by a different shading).

Controller 44 may then be configured to determine and/or assign an application rate of material (e.g., emulsion, slurry, asphalt, cement, primer, hardener, etc.) to each of the three subranges. The determination may be made based on the texture values (e.g., deviations from an average value) of the ranges, the environmental data, the road history data, the desired roadway parameters, the material details, etc. collected and/or received at Steps 304-306.

In one example, controller 44 may first determine a base application rate (the "base rate") for each subgroup dependent primarily on a texture value, an average value, or a deviation from a threshold value for the corresponding subrange and the road parameters received at Step 306 (Step 310). This determination may be made based on any method known in the art (e.g., the McLeod Chip Seal Design Method, the Hanson Method, the Modified Kearby Method, etc.). For instance, the portions of surface 18 that have been segmented into subgroup I may be assigned a base rate of 0.1 gal/yd based on an average texture of 0.5 mm; the portions of surface 18 that have been segmented into subgroup II may be assigned a base rate of 0.12 gal/yd based on an average texture of 2.0 mm; and the portions of surface 18 that have been segmented into subgroup III may be assigned a base rate of 0.14 gal/yd based on an average texture of 4.0 mm.

The base application rates may then be selectively adjusted higher or lower according to the other data collected and/or received at Step 304 (Step 312). For example, the base application rates may be selectively increased or decreased according to the environmental information and/or historical information.

For example, when a particular subgroup of surface segments is generally shaded by a geographical feature (e.g., a berm, a cliff, a mountain, a tree, a building, etc.) 23, the base rate for that subgroup may be selectively increased (e.g., by 0-5%, 5-10%, 10-20%, or 0-20%). In another instance, known proximal features that are likely to increase traffic flow (e.g., the location of a school or a shopping mall) may be cause for controller 44 to increase (e.g., by 0-5%, 5-10%, 10-20%, or 0-20%) the base rates of corresponding subgroups in the vicinity of the features. Similar regulation may be selectively implemented in areas that experience greater amounts of snow (e.g., geographical areas of higher elevation), due to mechanical forces of a plow acting on the aggregate within the corresponding subgroups. Areas likely to experience greater torsional forces on the aggregate (e.g., tight corners, sudden inclines, etc.) may also receive increased rates (e.g., by 0-5%, 5-10%, 10-20%, or 0-20%). In other areas located close to humidity sources (e.g., near bodies of water) and/or heat sinks (e.g., ravines), controller 44 may again increase the base rates (e.g., by 0-5%, 5-10%, 10-20%, or 0-20%). These increased base rates may provider greater adhesion in areas where the subsequently applied aggregate might otherwise tend to unravel.

While the above-cited examples focus adjustment according to historical and/or long-term conditions, controller 44 may similarly adjust the base rates according to actual and/or anticipated short-term information. For example, the base rates may be selectively increased or decreased based on anticipated and/or actual weather conditions (e.g., sun intensity, precipitation, temperature, etc.) and/or actual (e.g., measured) material conditions (e.g., temperature, viscosity, asphalt parameters, aggregate parameters, etc.) experienced during the road building event. For instance, controller 44 may selectively decrease (e.g., by 0-5%, 5-10%, 10-20%, or 0-20%) the base application rate when the temperature during building of road 14 is higher than the anticipated or historical temperatures.

The historical information may likewise be used by controller 44 to selectively increase or decrease the base rates. For example, controller 44 may consider parameters (e.g., application rates, aggregate specifications, etc.) used to build a section of an earlier or existing road at the same location intended for new road 14, along with a performance history (reports of bleeding, slippery roads, unraveling, vehicular damage, road failure, repairs, etc.) of the old road. For instance, based on a report of asphalt bleeding up through the aggregate and/or slippery roads, controller 44 may selectively decrease (e.g., by 0-5%, 5-10%, 10-20%, or 0-20%) the base application rate from what was used before. Similarly, based a report of unraveling and/or vehicular damage, controller 44 may selectively increase (e.g., by 0-5%, 5-10%, 10-20%, or 0-20%) the base application rate.

It should be noted that the general conditions described above as resulting in selective increases in the base application rate are examples only. In some situations, these same conditions could result in controller 44 selectively decreasing the base application rates, if desired. It should also be noted that, while mostly selective increases in the base application rates have been discussed above, selective decreases may be similarly implemented in response to the conditions following a generally opposite trend.

It is contemplated that, in addition to or instead of adjusting the base rates in the manners described above, controller 44 may selectively adjust properties of the materials being applied at the base rates. For example, controller 44 may selectively adjust a formulation of the materials (e.g., by mixing an additive into vessel 22 and/or implementing use of the primer), a temperature of the materials (e.g., by activating a heater 23 in vessel 22), a viscosity of the materials (e.g., by implementing use of the hardener), etc.

Controller 44 may generate the plan (e.g., texture map 42, road segmentation, the base rates for each segment, and selective adjustments to the base rates) for building road 14, and also regulate operation of machine(s) 12 to effectuate the plan (Step 314). In some embodiments, the plan is generated completely before building of road 14 begins. In these embodiments, the plan may be adjusted in real or near-real time during the building process as new information is received and processed by controller 44. In other embodiments, controller 44 may generate the plan during the building process (e.g., during the application of material to surface 18). In either situation, the plan may be executed in a semi-autonomous or completely autonomous manner (Step 314).

In semi-autonomous operations, the operator may maneuver an appropriately supplied/configured distributor (and/or other road building machines 12) to a start of surface 18 that is to be built up. In some applications, the operator may then signal a start to the road building operation (e.g., by activating arrangement 24 via control devices 38), and begin driving the distributor down the length of surface 18. In other applications, controller 44 may detect arrival at the start location and automatically activate arrangement 24.

In autonomous operations, controller 44 may regulate both the driving of the distributor and activation of arrangement 24 at the same time.

In either situation, as the distributor travels along surface 18, controller 44 may selectively activate and/or adjust the various components of arrangement 24 based on the plan. For example, controller 44 may selectively energize/de-energize/adjust pump(s) 26, spray bar(s) 28, nozzle(s) 30, valves 32, actuators 34, and/or conditioning devices. 23 associated with vessels 22 to achieve the adjusted base rates (and/or other parameters, such as temperature, viscosity, formula, etc.) of material application specified in the plan for each segment of surface 18.

Controller 44 may monitor the various input devices described above to ensure that, regardless of variations in driving control of the distributor, the plan is still executed. For example, controller may monitor the location, orientation, heading, ground speed, etc. of the distributor, determine an amount of delay between when a particular segment of surface 18 is first scanned for texture by a particular input device 52 and when that same segment passes into the spray area of a particular nozzle 30, and actively regulate the flow of material from that nozzle 30 to cover the segment with the planned amount of material. Similarly, controller 44 may monitor that same segment as it is covered with aggregate by the spreader to ensure that the aggregate specified for that segment is the same aggregate spread onto the segment and in the specified amount.

Controller 44 may adjust operation of arrangement 24 and/or machine 12 in a feed-forward, feed-back, and/or combination strategy. For example, based on the adjusted base rate for each segment of surface 18 and a monitored velocity of machine 12, controller 44 may determine a required flowrate of material through each nozzle 30 and adjust various settings of arrangement 24 based one or more known relationships stored in memory. Alternatively, the settings of arrangement 24 may be set to nominal values, and the flowrates of material through individual nozzles 30 and/or the buildup of material on individual segments may be monitored to generate feedback data (Step 316). Controller 44 may then incrementally adjust operation of arrangement 24 until the actual or monitored flowrates and/or buildup matches desired values. Finally, controller 44 may specify the original settings of arrangement 24 based on stored relationships, monitor results of these settings, and thereafter responsively adjust the settings as necessary. The monitoring of flowrates and/or buildup may be performed by any one or more of the input devices described above.

The feedback data generated at Step 316 from the various input devices associated with machine(s) 12 during the road building process may be used in a number of different ways, beyond regulation of the machines 12 during the process. For example, the feedback data may be stored together with the plan in one or more databases (e.g., database 46—referring to FIG. 2) for future use in rebuilding road 14 (e.g., to adjust future base rates based on actual performance). Additionally or alternatively, the feedback data may be used to confirm adherence to the plan, road specifications, and/or regulatory requirements. The feedback data may also be used for invoicing purposes (for example to quantify an amount, quality, and/or type of material used).

In some applications, the feedback generated at Step 316 may be used to schedule other operations associated with the road building process. For example, based on a monitored rate of material application (e.g., as observed via a thickness buildup, as imaged via a spray pattern, as detected via a flow rate, as indicated via a sonar level sensor and/or weight sensor associated with vessel 22, etc.), controller 44 may be capable of forecasting when and/or at what locations along surface 18 machine 12 requires refilling. Controller 44 may then be configured to automatically communicate (e.g., via a communication device—not shown) with a supply contractor, a machine operator, and/or a refilling machine itself (e.g., an autonomous machine) and coordinate a rendezvous at the anticipated refill location. In this manner, delays associated with refilling may be reduced.

The disclosed machine, system and method may improve the process of building and the quality of road 14. The process may be improved by reducing a time, labor and material cost associated with road 14. The time and labor may be reduced by automating many steps in the process via unique algorithms, and simultaneously implementing multiple operations in real or near-real time. The quality of road 14 may be improved by ensuring a "right" amount of the right material is applied to at all areas of road 14, taking into account geographical considerations, climate considerations, weather considerations, and history.

It will be apparent to those skilled in the art that various modifications and variations can be made to the disclosed machine, system and methods. Other embodiments will be apparent to those skilled in the art from consideration of the specification and practice of the disclosed machine, system and methods. For example, in some embodiments, it may be possible to omit texture detection and instead determine the application rates for the different segments of surface 18 in another manner. It may still be possible to track location information for each of these segments and regulate operation of arrangement 24 in the same manner discussed above. In another example, although much of this disclosure focuses on regulating application rates of sprayed materials from a distributor, the disclosed methods could similarly be applied to the application of aggregate by a spreader based on detected textures and/or machine location. It is intended that the specification and examples be considered as exemplary only, with a true scope being indicated by the following claims and their equivalents.

What is claimed is:

1. A road building machine, comprising:

a vehicle;

a distribution arrangement mounted to the vehicle and configured to distribute a material on to a surface as the vehicle moves over the surface;

at least one sensor mounted to the vehicle and configured to generate a signal indicative of a texture of the surface during movement of the vehicle over the surface;

a locating device configured to detect a location of the texture; and a controller in communication with the distribution arrangement, the at least one sensor, and the locating device, the controller being specially programmed to:

determine an amount of the material to be applied to the location of the texture based on the signal; and automatically cause the distribution arrangement to distribute the amount of the material on to the surface at the location of the texture as the vehicle moves over the surface.

2. The road building machine of claim 1, wherein the controller is further programmed to determine a time required for an application area of the distribution arrangement to pass from a current location to the location of the texture, wherein to automatically cause the distribution arrangement to distribute the amount of the material to the surface includes selectively activating an application component of the distribution arrangement after the time required for the location of the texture to pass into the application area has expired.

3. The road building machine of claim 1, wherein:

the at least one sensor is mounted at a leading end of the vehicle; and the distribution arrangement is located at a trailing end of the vehicle.

4. The road building machine of claim 3, wherein:

the material is an asphalt material; and the distribution arrangement includes a plurality of nozzles arranged across a width of the vehicle and configured to spray the spray the asphalt material.

5. The road building machine of claim 4, wherein:

the plurality of nozzles are grouped into a plurality of groupings that are independently controllable; and a number of the at least one sensor is equal to a number of the plurality of groupings of the plurality of nozzles that are independently controllable.

6. The road building machine of claim 5, wherein:

the at least one sensor is configured to generate a plurality of signals indicative of the texture and at least one additional texture detected at different location of the surface;

the amount of the material is a volumetric amount per area of the surface over which the vehicle is moving; and the controller is programmed to determine the amount of the material to be applied by each of the groupings of the plurality of nozzles based on the texture and the at least one additional texture of the surface detected at a plurality of different locations by the at least one sensor.

7. The road building machine of claim 6, wherein the controller is further programmed to:

group different locations of the surface into a plurality of groups based on different textures detected at the different locations; and determine a different base application rate of the volumetric amount per area for each of the plurality of groups.

8. The road building machine of claim 7, wherein the controller is further programmed to:

receive at least one of environmental data and historical data for the different locations; and selectively adjust the different base application rates according to at least one of environmental data and historical data.

9. The road building machine of claim 8, wherein the controller is programmed to cause the distribution arrangement to automatically apply the selectively adjusted different base application rates to the different locations based on the grouping.

10. The road building machine of claim 9, wherein the controller is further programmed to generate a virtual map of the surface based on the different locations, the textures and the plurality of groups.

11. The road building machine of claim 8, further including at least one additional sensor mounted on the vehicle and configured to generate the at least one of environmental data and historical data in real or near-real time as the distribution arrangement is caused to distribute the amount of the material.

12. The road building machine of claim 8, wherein the controller is programmed to receive the at least one of environmental data and historical data from a database.

13. The road building machine of claim 8, wherein environmental data includes at least one of geographical information, climate information, weather information, or traffic information.

14. The road building machine of claim 13, wherein the geographical information includes an exposure of the surface to at least one of the sun, a wind, a body of water, or a heat sink.

15. The road building machine of claim 13, wherein the climate information includes at least one of a historical temperature, a humidity, or precipitation parameter experienced at the surface.

16. The road building machine of claim 13, wherein the weather information includes environmental conditions at least one of anticipated or experienced at a time that the distribution arrangement is caused to automatically apply the amounts of the material.

17. The road building machine of claim 8, wherein the historical data includes information regarding historical performance of an existing road previously built at the location of the surface.

18. The road building machine of claim 8, wherein the historical data includes at least one of an application rate used to build the existing road, a recorded failure of the existing road, recorded vehicular damage caused during travel on the existing road, or maintenance records for the existing road.

19. The road building machine of claim 8, wherein the controller is further programmed to selectively cause the distribution arrangement to automatically apply at least one of a primer or a hardener to the surface based on the at least one of environmental data or historical data.

20. The road building machine of claim 1, wherein:

the material is an asphalt material;

the amount of the material is selected at least in part based on a specified parameter of aggregate to be subsequently applied on top of the material;

the distribution arrangement further includes at least one additional sensor configured to detect an actual parameter of the aggregate during application of the aggregate onto the material; and the controller is further configured to selectively adjust the amount of the material being applied based on the actual parameter of the aggregate.

21. The road building machine of claim 1, wherein the controller is further programmed to:

monitor the amount of the material being applied by the distribution arrangement; and selectively coordinate a rendezvous with a supply machine based on the monitoring.

22. A road building machine, comprising:

a vehicle;

a distribution arrangement mounted at a trailing end of the vehicle and configured to spray an asphalt material through a plurality of nozzles onto a surface as the vehicle moves over the surface;

a plurality of sensors mounted across a leading end of the vehicle and configured to generate signals indicative of textures of the surface during movement of the vehicle over the surface, wherein a number of the plurality of sensors is equal to a number of independently controllable groups of the plurality of nozzles;

a locating device mounted to the vehicle and configured to detect locations of the textures; and a controller in communication with the distribution arrangement, the plurality of sensors, and the locating device, the controller being specially programmed to:

determine amounts of the material to be applied to the locations of the textures based on the signals; and automatically cause the distribution arrangement to distribute the amounts of the material onto the surface at the locations of the textures as the vehicle moves over the surface.

23. The road building machine of claim 22, wherein the distribution arrangement includes:

at least one spray bar in fluid communication with the plurality of nozzles; and at least one pump associated with the at least one spray bar, wherein the controller is programmed to adjust operation of the at least one pump based on a velocity of the vehicle.

24. A distribution arrangement for a road building machine, comprising:

a vessel mountable to the road building machine and configured to hold an asphalt material;

a spray bar configured to extend across a trailing end of the road building machine;

a pump configured to press the asphalt material from the vessel through the spray bar;

a plurality of nozzles in fluid communication with the spray bar and configured to spray the asphalt material onto a surface as the road building machine moves over the surface;

a plurality of valves configured to regulate flows of the asphalt material through the plurality of nozzles;

a plurality of sensors configured to mount across a leading end of the road building machine and to generate signals indicative of textures of the surface during movement of the road building machine over the surface, wherein a number of the plurality of sensors is equal to a number of independently controllable groups of the plurality of nozzles;

a locating device configured to mount to the road building machine and to detect locations of the textures; and a controller in communication with the plurality of valves, the plurality of sensors, and the locating device, the controller being specially programmed to:

determine amounts of the asphalt material to be applied to the locations of the textures based on the signals; and automatically cause the plurality of valves to pass the amounts of the asphalt material through the plurality of valves and on to the surface at the locations of the textures as the road building machine moves over the surface.

25. The distribution arrangement of claim 24, wherein the controller is further programmed to:

receive at least one of environmental data and historical data for the locations of the textures; and selectively adjust the amounts of the asphalt material according to at least one of environmental data and historical data.

* * * * *